United States Patent [19]

Marquardt

[11] 4,236,557

[45] Dec. 2, 1980

[54] METHOD FOR MANUFACTURING WOOD MOULDINGS

[75] Inventor: Mark O. Marquardt, Amherst, Canada

[73] Assignee: Conduit-Amherst Limited, Mississauga, Canada

[21] Appl. No.: 13,897

[22] Filed: Feb. 22, 1979

[51] Int. Cl.[3] ..... B27D 1/10; B27M 3/08

[52] U.S. Cl. ..... 144/315 R; 83/581; 144/2 R; 144/309 L; 144/317; 156/159

[58] Field of Search ..... 83/371, 471.3, 581; 156/98, 159 R, 258, 266; 144/1 R, 2 R, 3 R, 121, 147, 136 R, 162 R, 309 R, 309 D, 309 L, 310 R, 310 B, 314 R, 316, 315 R, 317, 321, 323

[56] References Cited

U.S. PATENT DOCUMENTS

| | | | |
|---|---|---|---|
| 2,652,864 | 9/1953 | Anguera | 83/371 |
| 2,770,272 | 11/1956 | Morrison | 144/316 X |
| 2,942,635 | 6/1960 | Horne | 144/310 |
| 3,461,932 | 8/1969 | Shelton et al. | 144/317 |
| 3,780,777 | 12/1973 | Davies | 83/371 X |
| 3,871,258 | 3/1975 | Hurn | 83/371 X |
| 4,152,961 | 5/1969 | Batson | 83/471.3 |
| 4,164,248 | 8/1979 | Rysti | 144/2 R X |

OTHER PUBLICATIONS

Modern Plastics, "Scarfed Joints in Plywood", pp. 74, 75, 116, 118, 120; Sep. 1942.

*Primary Examiner*—W. Donald Bray
*Attorney, Agent, or Firm*—Fetherstonhaugh & Co.

[57] ABSTRACT

A method of converting a longitudinally elongated moulding rip having a portion containing a flaw such as a knot which is unacceptable in clear grade mouldings, into a substantially flawless premium length clear grade moulding, the rip having first and second flawless portions of substantially matching grain and a length less than a premium length, on either side of the portion containing the flaw, comprises the steps of cutting said rip transversely of its longitudinally elongated extent at both ends of the portion containing the flaw to provide smooth complementary first and second scarf joint faces on the ends of the first and second flawless portions respectively disposed adjacent the portion containing the flaw, removing the portion containing the flaw from between said first and second scarf joint faces, bonding said first and second scarf joint faces of said first and second flawless portions to one another to form a scarf joint connecting said first and second flawless portions to form a rip having a premium length, working the rip to produce a profiled moulding having a substantially flawless clear grade surface finish.

2 Claims, 6 Drawing Figures

METHOD FOR MANUFACTURING WOOD MOULDINGS

FIELD OF INVENTION

This invention relates to the manufacture of clear grade wood mouldings. In particular, this invention relates to a method of converting a longitudinally elongated moulding rip having a flaw containing portion therein into a flawless premium length clear grade moulding.

PRIOR ART

Wood mouldings are currently manufactured in both "paint grade" and "clear grade" quality. The "paint grade" mouldings are mouldings which are intended to be painted upon installation and consequently the quality of the surface finish of the moulding is not important. Paint grade mouldings tend to be inexpensive mouldings and are not the type of moulding to which the present invention relates. "Clear grade" or "natural grade" mouldings are mouldings in which the surface finish must be substantially free of flaws such as those resulting from the presence of a "knot".

Moulding manufacturers customarily obtain good quality lumber for use in the manufacture of "clear grade" mouldings. Generally, the moulding rip of the quality used for producing clear grade moulding will have an average length of about twelve feet and will contain no more than two flaws.

In the present method of manufacturing mouldings, the board which is purchased by the moulding manufacturer is cut into rips of approximate width required by the moulding, the rips are then worked to provide the required mould profile and if flaws are present, the portions containing the flaws are cut out of the length. Consequently, the manufacturer finds that from any particular batch of lumber which he machines in the conventional manner he produces a number of lengths measuring seven feet and over, all of which he can classify as "premium length" lumber and a number of lengths which are less than seven feet but fall within the range of about three to six feet which are known as "shorts".

If the purchaser is prepared to pay a premium price, which may be about 20% greater than the standard lineal price for mouldings, he may be able to obtain mouldings all of which are of the "premium length" that is to say, seven feet or over. In some instances, a purchaser may be prepared to pay this additional price knowing that "shorts" are no value to him in a particular application.

By far the greatest volume of moulding sales are those in which the purchaser is prepared to pay the standard lineal price for mouldings and as a result of which he is required to accept up to 20% shorts in any one order. As previously indicated, shorts are lengths measuring from three to six feet. The remainder of the load will be of the "premium length".

In most instances, the purchaser would prefer to receive all of the order in units of the "premium length", however, he accepts the load including the shorts in order to avoid payment of the "premium price". In many instances, the shorts cannot be effectively used and are merely discarded as waste.

Despite the fact that the desirability of providing mouldings in the "premium length" has been known for some considerable time, the industry has continued to accept the practice of including "shorts" in a standard load.

In the production of "paint grade" mouldings, it is known to use a "finger joint" to connect "shorts". The "finger joint" is however quite unsuitable for use in the production of clear grade mouldings because in the forming of the profile of the moulding, various portions of the mating fingers of the joint are exposed thereby creating a disruption in the pattern at the face of the moulding which is not acceptable in "clear grade" mouldings because these mouldings are generally finished in a manner which will permit the grain of the wood to be visible at the surface of the moulding.

A "scarf joint" is a joint which is known to skilled carpenters and has been used by skilled carpenters for connecting lengths of mouldings at a job site in order to provide lengths suitable for use in finishing a room or the like, particularly where the length required is greater than the "premium length". This practice has, however, relied to a very large extent on the skill of the individual carpenter and is not widely used because considerable skill is required in order to make an effective scarf joint. Consequently, in most cases a simple butt joint is made by a carpenter in present day installation where a joint is necessary. The scarf joint requires a very precise cutting of the moulding in a plane which is angularly inclined in two directions with respect to the longitudinal extent of the moulding. Because of the complexity of the scarf joint, it is not widely used in the installation of mouldings. It is to be noted that the use of a scarf joint in this application is limited to a joint made by a carpenter in a finished moulding. To the best of my knowledge a scarf joint has not previously been used in a preliminary step in the manufacture of moulding prior to the machining of the required moulding contour.

The present invention overcomes the difficulties of the prior art described above and provides a method of manufacturing substantially flawless premium length mouldings from moulding rips having portions containing a flaw which is unacceptable in a clear grade moulding.

According to one aspect of the present invention there is provided a method of converting a longitudinally elongated moulding rip having a portion containing a flaw such as a knot which is unacceptable in clear grade mouldings, into a substantially flawless premium length moulding, the rip having first and second flawless portions of substantially matching grain and a length less than a premium length, on either side of the portion containing the flaw, comprising the steps of; cutting said rip transversely of its longitudinally elongated extent at both ends of the portion containing the flaw to provide smooth complementary first and second scarf joint faces on the ends of the first and second flawless portions respectively disposed adjacent the portion containing the flaw, removing the portion containing the flaw from between said first and second scarf joint faces, bonding said first and second scarf joint faces of said first and second flawless portions to one another to form a scarf joint connecting said first and second flawless portions to form a rip having a premium length, working the rip to produce a profiled moulding having a substantially flawless clear grade surface finish.

The invention will be more clearly understood after reference to the following detailed specification read in conjunction with the drawings wherein.

Figure 1:
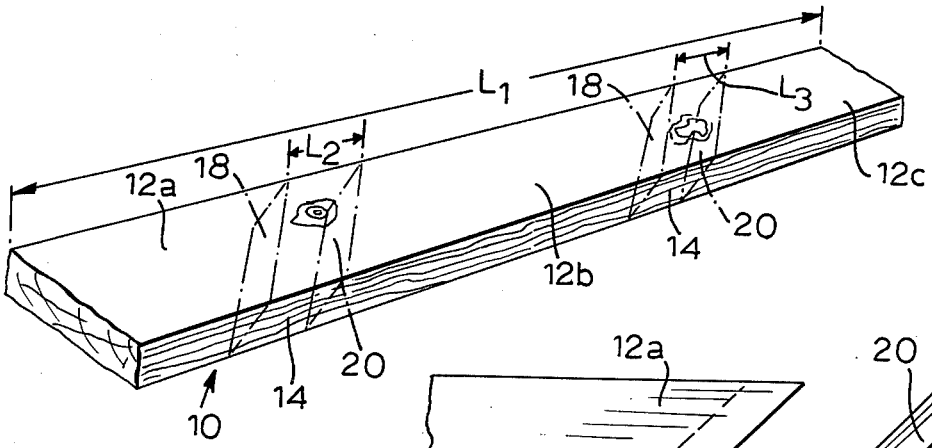
FIG. 1 is a pictorial view of a longitudinally elongated moulding rip in which flaws are present.
Figure 2:
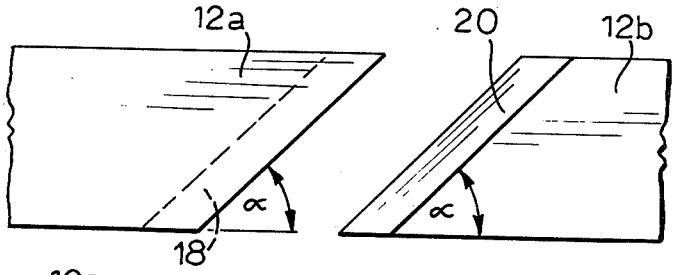
FIG. 2 is a plan view of a portion of the rip of FIG. 1 after the removal of the portion containing the flaw.
Figure 3:
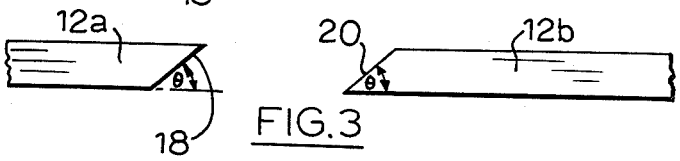
FIG. 3 is a side view of the rip of FIG. 1.

With reference to FIG. 1 of the drawings, the reference numeral 10 refers generally to a longitudinally elongated moulding rip. Moulding rip 10 has two portions containing flaws which are identified by the reference numeral 14 and three flawless portions 12*a*, 12*b* and 12*c*. The flaw in the portions 14 may be in the form of a knot or a surface damage of the type which would make it impossible to convert the rip into a premium length moulding. To be acceptable for conversion by the method of the present invention, the length L1 must be greater than the premium length, which is generally about seven feet, by an amount equal to the sum of the length L2 and L3 which must be removed in order to remove the portions 14.

Having determined that a sufficient length may remain after the removal of the portions containing the flaw, the rip is then cut on either side of the flaw to form smooth complementary first and second scarf joint faces 18 and 20. Preferably the scarf joint faces 18 and 20 are angularly inclined to the width of the rip at an angle $\alpha$ of about 45° and through the thickness of the rip at an angle $\theta$ of about 45°.

An adhesive is then applied to one or both of the scarf joint faces 18 and 20 of adjacent flawless portions 12*a* and 12*b* or of adjacent flawless portions 12*b* and 12*c*. The flawless portions 12*a* are preferably connected to the flawless portions 12*b* rather than to the flawless portions 12*c* so that there is a minimum disrruption in the natural grain pattern of the wood at each joint. This is important because of the desire to provide mouldings of a clear grade.

Figure 4:
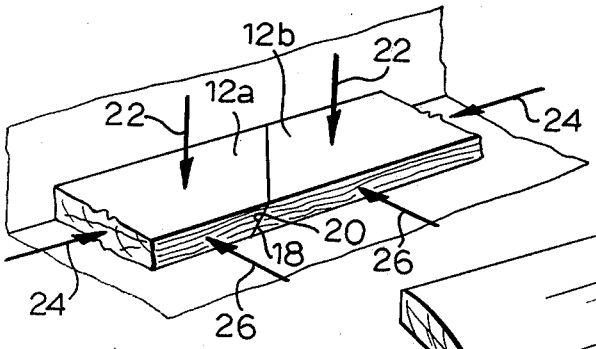
FIG. 4 is a pictorial view of the first and second flawless portions arranged with the scarf joint faces disposed in abutting relationship.

The portions 12*a* and 12*b* are positioned as illustrated in FIG. 4 of the drawings with the scarf faces 18 and 20 in abutting relationship. As will be described hereinafter the machine used to form the bond provides clamping forces in the direction of the arrows 22, 24 and 26 which serve to maintain a pressure at the interface until the bond formed therebetween is set. It has been found that with present technology a satisfactory bond can be obtained in a very short period of time hence by the use of a high frequency gluing technique.

The flawless portions 12*b* and 12*c* are bonded to one another in the manner previously described with respect to flawless portions 12*a* and 12*b*.

Figure 5:
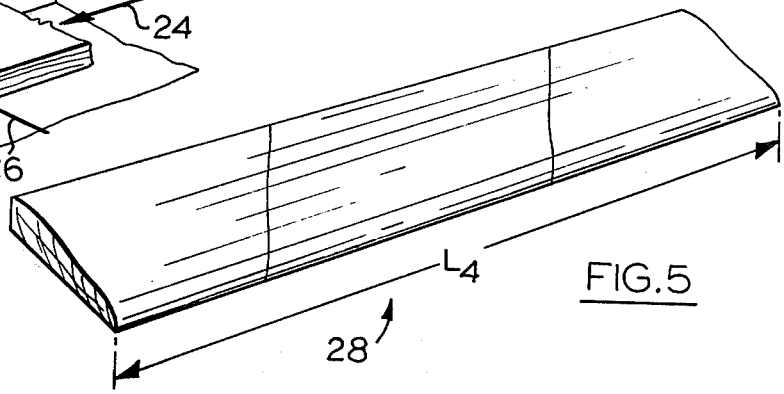
FIG. 5 is a pictorial view of a finished moulding formed from the rip of FIG. 1.

The rip thus formed will have a length which is at least equal to the required "premium length" of the moulding to be produced therefrom. The rip is then worked in conventional mould forming machinery to the required contour. Because the joints previously formed in the rip are scarf joints the only evidence of the joint which is visible at the surface of the moulding is a simple hair line 21 which will extend obliquely across the finished face in attrusive straight line. It will be noted that one attempt has been made to illustrate the normal grain pattern of a wood moulding in FIG. 5 with the result that the hair line 21 is much more conspicuous in this illustration than it is in a wood moulding having a normal wood grain finish. It has been found that the joint produced in this manner is totally acceptable in most mouldings as being less of a disruption in the face of the moulding that natural imperfections and variations in grain character of mouldings.

It has been found that clear grade mouldings can be produced by the moulding of the present invention in a wide variety of woods commonly used in clear grade quality including mahogony, walnut, oak and the like and it may also be used in the less expensive woods such as pine, spruce, fir and hemlock.

Figure 6:
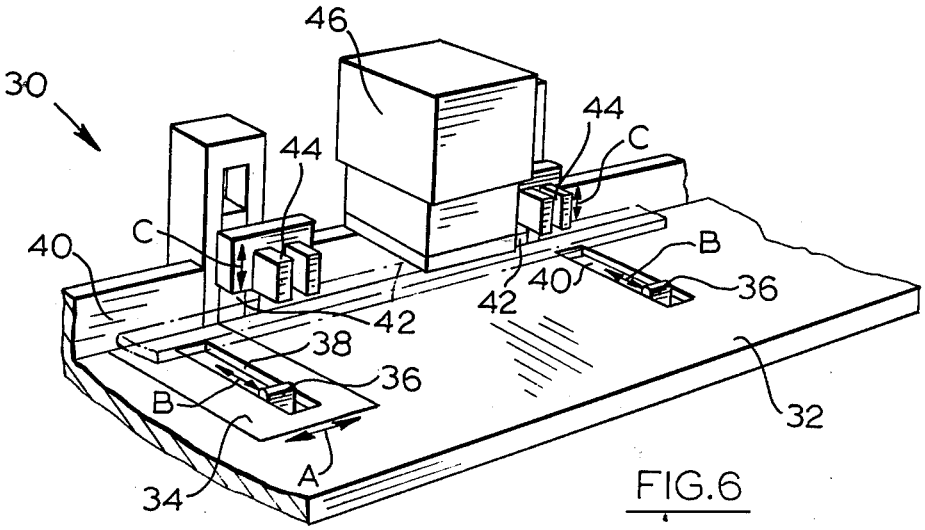
FIG. 6 is a pictorial view of an apparatus for use in positioning the scarf joint faces of the ends of adjacent flawless portions in an abutting relationship and forming a bond therebetween.

In FIG. 6 of the drawings, the reference numeral 30 refers generally to a machine for positioning the sash joint faces in an abutting relationship in order to effect gluing thereof. The machine includes a stationary table 32 on which a platform 34 is mounted to reciprocate in the direction of the arrows A. A pair of fingers 36 are arranged to project upwardly through slots 38 and 40 formed in the platform 34 and table 32 respectively. The fingers 36 are mounted to be reciprocally driven in the direction of the arrows B toward and away from a back stop plate 40. A pair of pressure pads 42 are positioned above the table 32 and platform 34 respectively and are mounted on reciprocating drive units 44 so as to be reciprocally driven toward and away from the table 32 and platform 34 respectively in the direction of the arrow C. A high frequency glue head 46 is located above the platform 34 so as to direct high frequency energy to the scarf joint in use.

In use, a flawless length 12*b* may be located on the table 32 and a flawless length 12*a* may be located on the platform 34 with their scarf joint faces 18 and 20 positioned adjacent one another, preferably in a simple abutting relationship. The various clamping mechanisms are then activated to engage the flawless portions 12*a* and 12*b* and to move them toward one another to firmly clamp the scarf faces 18 and 20 against one another. The high frequency gluing machine is then activated to form the required bond. Thereafter the rip is removed and a further joint made at the second set of sash joint faces.

From the foregoing it will be apparent that the present invention provides a simple and efficient method of converting a longitudinally elongated moulding rip having a portion containing a flaw into a flawless premium length moulding.

What I claim as my invention is:

1. A method of converting a longitudinally elongated moulding rip having a portion containing a flaw such as a knot which is unacceptable in clear grade mouldings, into a substantially flawless premium length clear grade moulding, the rip having first and second flawless portions of substantially matching grain and a length less than a premium length, on either side of the portion containing the flaw, comprising the steps of;

(a) cutting said rip transversely of its longitudinally elongated extent at both ends of the portion containing the flaw to provide smooth complementary first and second scarf joint faces on the ends of the first and second flawless portions respectively disposed adjacent the portion containing the flaw, (b) removing the portion containing the flaw from between said first and second scarf joint faces, (c) bonding said first and second scarf joint faces of said first and second flawless portions to one another to form a scarf joint connecting said first and second flawless portions to form a rip having a premium length, (d) working the rip to produce a profiled moulding having a substantially flawless clear grade surface finish.

2. A method as claimed in claim 1 wherein the transverse cut which is formed in the rip is angularly inclined with respect to the transverse extent of the rip to provide a greater surface area for bonding than would be available from a cut which extends parallel to the transverse extent of the rip.

* * * * *